US011319662B2

(12) United States Patent
Dewald et al.

(10) Patent No.: US 11,319,662 B2
(45) Date of Patent: May 3, 2022

(54) DRYING APPARATUS AND DRUM

(71) Applicants: Chuck Dewald, Talbott, TN (US); Thomas L. Cristello, Randolph, NJ (US)

(72) Inventors: Chuck Dewald, Talbott, TN (US); Thomas L. Cristello, Randolph, NJ (US)

( * ) Notice: Subject to any disclaimer, the term of this patent is extended or adjusted under 35 U.S.C. 154(b) by 0 days.

(21) Appl. No.: 17/156,878

(22) Filed: Jan. 25, 2021

(65) Prior Publication Data

US 2021/0246605 A1 Aug. 12, 2021

Related U.S. Application Data

(60) Provisional application No. 62/972,998, filed on Feb. 11, 2020.

(51) Int. Cl.
*D06F 58/26* (2006.01)
*D06F 58/04* (2006.01)

(52) U.S. Cl.
CPC ..... *D06F 58/26* (2013.01); *D06F 58/04* (2013.01)

(58) Field of Classification Search
CPC ..... D06F 58/26; D06F 58/04; D06F 58/02
USPC ..... 34/134, 128
See application file for complete search history.

(56) References Cited

U.S. PATENT DOCUMENTS

| | | | | |
|---|---|---|---|---|
| 3,696,521 | A * | 10/1972 | Hubbard | D06F 58/04 34/128 |
| 3,840,998 | A * | 10/1974 | Marcussen | D06F 58/04 34/128 |
| 7,942,025 | B1 | 5/2011 | Musone | |
| 8,312,640 | B2 | 11/2012 | Taniguchi et al. | |
| 9,214,345 | B2 | 12/2015 | Ohashi et al. | |
| 9,828,715 | B2 | 11/2017 | Kwon et al. | |
| 2005/0155250 | A1 | 7/2005 | Chung et al. | |
| 2015/0017791 | A1 | 1/2015 | Ohashi et al. | |
| 2015/0121717 | A1* | 5/2015 | Denke | B22C 5/08 34/468 |
| 2016/0153131 | A1 | 6/2016 | Geun et al. | |
| 2017/0218562 | A1 | 8/2017 | Lv et al. | |
| 2018/0371677 | A1 | 12/2018 | Oak et al. | |

FOREIGN PATENT DOCUMENTS

| | | | |
|---|---|---|---|
| CN | 201056645 | Y | 5/2008 |
| CN | 203113114 | U | 8/2013 |
| CN | 105648719 | A | 6/2016 |
| CN | 106968090 | A | 7/2017 |
| EP | 1449953 | B1 | 9/2016 |
| JP | 10165695 | A | 6/1998 |

(Continued)

*Primary Examiner* — Edelmira Bosques
*Assistant Examiner* — Bao D Nguyen
(74) *Attorney, Agent, or Firm* — Millen, White, Zelano & Branigan, P.C.; William F. Nixon

(57) ABSTRACT

A dryer includes a drum to rotate while drying articles, such as clothes, using heated air. The drum includes an outer cylindrical wall and an inner cylindrical wall that fits within the outer cylindrical wall. An air passage is formed between the outer cylindrical wall and the inner cylindrical wall to receive heated air directed to the drum. The inner cylindrical wall includes holes into the interior of the drum. The heated air within the air passage passes through the holes into the interior of the drum to directly contact the articles.

20 Claims, 7 Drawing Sheets

(56) References Cited

FOREIGN PATENT DOCUMENTS

| | | | |
|---|---|---|---|
| JP | 2013118879 | A | 6/2013 |
| JP | 2014014584 | A | 1/2014 |
| WO | 09027306 | A1 | 3/2009 |

* cited by examiner

DRYING APPARATUS AND DRUM

BACKGROUND OF THE INVENTION

Field of the Invention

The present invention relates to a dryer using heated air to dry items, such as clothes. More particularly, the present invention relates to a dryer using an improved drum design to deliver heated air to the items.

Discussion of the Related Art

Clothes dryers basically work in the same manner. The dryer sucks in air from the surrounding area. The dryer heats the air using an electric heating element, a gas burner and the like. The air passes into a tumbler, or drum, housed within the dryer once it is heated. The hot air evaporates water from the clothes as they spin inside the tumbler. The dryer then forces the water evaporated from the clothes along with the hot air outside its assembly. Typically, a vent allows the air and moisture to exit the room.

Articles, such as clothes, towels, rugs and the like, take a certain amount of time to dry. The amount of time varies according to the article being dried. Other factors to this time period are energy capacity of the heating element, efficiency of heat transfer, air flow capacity, vapor pressure and the like. Some of these factors may be beyond the control of the dryer, while others may be controlled or monitored to improved drying times and efficiency.

The dryer pulls heated air through a main port in the back of the drum. The heated air moves through the drum to contact the items, such as clothes. After removing moisture from the clothes, the air exits out of the front of the drum. This process results in limited surface area for the heated air to come into contact with the items in the drum. Further, the heated air immediately cools down once it enters the drum and as it travels to the other side. Because clothes are tumbling on the outside of the interior of the drum due to centrifugal forces, a portion of the heated air bypasses the wet clothes all together. This process is inefficient in its use of the heated air within the drum.

SUMMARY OF THE INVENTION

The disclosed embodiments of the present invention relate to a dryer apparatus that improves drying efficiency and reduces the amount of time needed to dry articles within the apparatus. The disclosed dryer and drum distribute the heated air in a more efficient manner without significant changes to the dryer operation. Additional heaters or redesign of the dryer is not needed. Instead, the improved dryer configuration improves air flow and heating efficiency.

A dryer is disclosed. The dryer includes a housing. The dryer also includes an inlet air path into the housing. The dryer also includes an outlet air path out of the housing. The dryer also includes a heating element positioned to receive the inlet air path to heat air. The dryer also includes a drum to receive the heated air and to rotate within the housing. The drum includes an outer cylindrical wall. The drum also includes an inner cylindrical wall to fit within the outer cylindrical wall. The inner cylindrical wall includes holes. The drum also includes an air passage formed between the outer cylindrical wall and the inner cylindrical wall to receive the heated air from the inlet air path. The heated air exits the air passage through the holes in the inner cylindrical wall and then exits the drum into the outlet air path.

A drum to dry articles is disclosed. The drum includes an outer cylindrical wall. The drum also includes an inner cylindrical wall to fit within the outer cylindrical wall. The inner cylindrical wall includes holes. The drum also includes an air passage formed between the outer cylindrical wall and the inner cylindrical wall to receive air to flow into an interior of the drum. The interior is defined by the inner cylindrical wall. The air exits the air passage through the holes in the inner cylindrical wall.

A method for drying articles within a dryer is disclosed. The method includes heating air within an inlet air path within the dryer. The method also includes flowing the heated air through an air inlet to a drum. The method also includes moving the heated air within an air passage formed by an outer cylindrical wall and an inner cylindrical wall of the drum. The inner cylindrical wall includes holes. The method also includes exiting the heated air from the air passage through the holes in the inner cylindrical wall into an interior of the drum. The method also includes removing moisture from the articles within the interior of the drum using the heated air.

The drum disclosed above may be separated into chambers also having holes to promote the exit of heated air into the drum. These features increase the amount of heated air directed to the surface area of articles, such as wet clothes.

BRIEF DESCRIPTION OF THE DRAWINGS

The accompanying drawings are included to provide further understanding of the invention and constitute a part of the specification. The drawings listed below illustrate embodiments of the invention and, together with the description, serve to explain the principles of the invention, as disclosed by the claims and their equivalents.

DETAILED DESCRIPTION OF THE PREFERRED EMBODIMENTS

Figure 1:
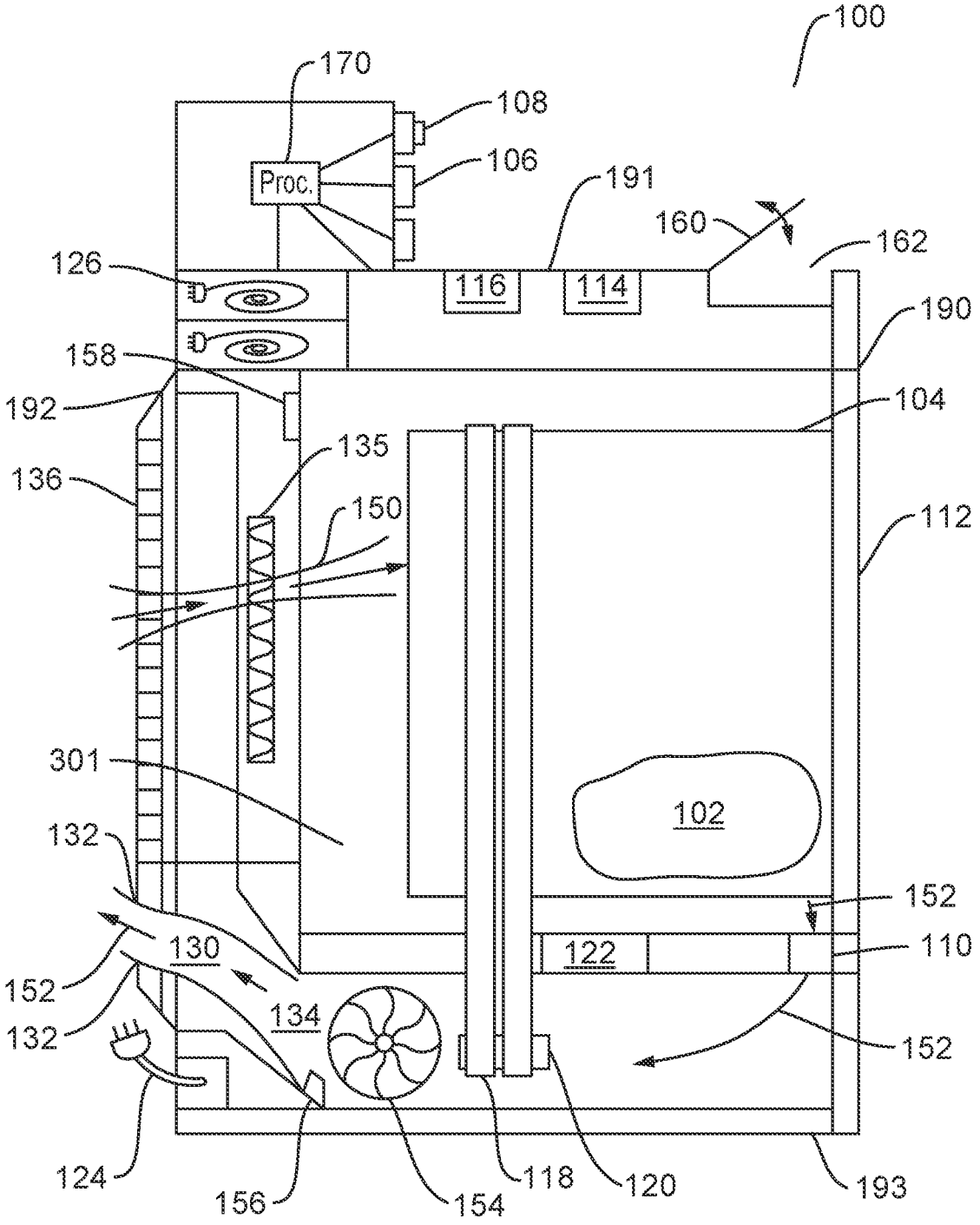
FIG. 1 illustrates a dryer according to the disclosed embodiments.

Aspects of the invention are disclosed in the accompanying description. Alternate embodiments of the present invention and their equivalents are devised without parting from the spirit or scope of the present invention. It should be noted that like elements disclosed below are indicated by like reference numbers in the drawings.

The disclosed embodiments improve the design of the drum within the dryer to increase the surface area within the drum for heat transfer to the clothes, increase direct airflow of the heated air across the clothes, and decrease the heated air wasted by not coming into contact with the items in the drum. The closer and more direct heated airflow that comes into contact with the items in the drum results in quicker drying times.

The disclosed drum is double walled and possibly broken into multiple chambers to deliver the heated air directly to the items within the drum. The drum may be broken into any number of chambers, or no chambers. The drum may accommodate the insertion and removal of walls to form the chambers. The drum and chamber walls include holes to allow the heated air to exit into the applicable part of the drum. The holes may vary in size depending on their distances from the entrance port of the heated air.

The disclosed embodiments allow heated air to come from the back of the drum and force the heated air through the entire length of the drum, including any chambers. This feature increases the surface area available for energy transfer to the wet clothes. "Surface area" may refer to area of clothes that comes into contact with the heated air. It will be appreciated according to the disclosed embodiments that the heated air contacts a larger amount of the articles being dried than conventional drying systems. The amount of direct airflow that comes into contact with the wet items increases drying efficiency by decreasing drying times for the same electrical load or heater capacity, regardless of the dryer settings.

The curved portions of the walls for the three chambers provide efficient tumbling for the items without modification of the existing insets in current dryers. This feature helps maintain drying capacity while not reducing capacity in the drum. The holes for the heated air may be placed along the entire length of the drum as well as in the walls forming any chambers to provide maximum contact of the heated air to the clothes. The number and size of the holes may vary. Some embodiments may have holes of different sized depending on their location within the drum.

The disclosed embodiments provide a significant increase in surface area for moisture transfer to the air, more direct air flow, and less wasted air that bypasses the items in the drum. These results are accomplished without significant redesign of the dryer or drum, especially for existing models and makes. Minimal reduction in capacity, such as 1 to 2% in volume, of the drum may occur but this may be offset by reduced drying times and increases efficiency. Further, dryers should not be loaded to "capacity" to avoid wear and tear on the drum assembly. Thus, the same amount of clothes should be able to be handled by the disclosed dryer and drum.

FIG. 1 depicts a dryer 100 according to the disclosed embodiments. Dryer 100 is a dryer using forced, heated air to remove moisture and wetness from articles, such as clothes, towels, fabric, dishes, household items, and the like. Article 102 represents one of such articles, or a plurality of articles, within dryer 102. Preferably, article 102 is contained within a rotating drum 104. Article 102 tumbles within drum 104 to allow the heated air to flow over its surface to remove moisture. Drum 104 is disclosed in greater detail below.

Dryer 100 intakes outside air from its surrounding environment and expels the air after it has cycled through drum 104. This process is disclosed in greater detail below. Dryer 100 also includes controls 106 to adjust settings and operations for drying articles. Controls 106 may be knobs, buttons, displays, and the like. Indicator 108 alerts a user that lint screen 110 should be cleaned. Preferably, indicator 108 is a light that comes on to alert the user.

Dryer 100 also includes door 112. FIG. 1 shows door 112 on the front side of dryer 100, but door 100 may be placed on any side or surface of dryer 100. For example, door 112 may be located on the top of dryer 100 if that side is considered more convenient or accessible. Article 102 is placed into and removed from drum 104 via door 112. Thermostat 114 controls the temperature in drum 104 and uses information provided by sensor 116 to determine whether to increase or decrease the amount of heated air forced onto article 102. Door 112 may be sized to include the insertion of components within drum 104, as disclosed below.

Belts 118 rotate drum 104. Although FIG. 1 shows two belts, the number of belts may vary according to the needs and size of dryer 100. Moreover, other means for rotating drum 104 can be employed and dryer 100 is not limited to using belts. Belts 118 may be attached to a rotor 120. Rotor 120 is controlled by motor 122, which receives commands set by controls 106. Again, rotor 120 and motor 122 may be any configuration or type commonly used in dryers.

Power to dryer 100 is provided via power cord 124. Preferably, power cord 124 includes a 220 volt plug that interacts with a wall outlet. Alternatively, power may be supplied through two 110 volt plugs 126 stored within dryer 100. Plugs 126 provide an alternate power source should the 220 volt plug be unavailable.

Dryer duct 130 couples vent 134 of dryer 100 to the outside. Preferably, duct 130 connects to a vent within a wall. Duct 130 is coupled to dryer 100 using clips 132. Duct 130 may be comprised of rigid material that does not collapse during common use. The rigidity ensures that good air flow occurs at all times while dryer 100 is in use. Backed up air from poor air flow may cause problems within dryer 100.

Lint screen 110 separates drum 104 from vent 134. Vent 134 allows air from drum 104 to exit dryer 100 through duct 130. Fan 154 draws air filled with moisture from article 102 into vent 134. If the air is saturated with moisture, then the removal of moisture from article 102 is compromised. Thus, the air from drum 104 cycles outside dryer 100. Fan 154 sucks the air through lint screen 110, which removes dirt, fluff and other materials from the air so that vent 134 does not become clogged.

Dryer 100 also includes vents 136 that allow air to flow into drum 104. Vents 136 may use small openings to keep foreign objects and materials out of dryer 100. Heating element 135 heats the air as it enters drum 104 in order to dry article 102. Heating element 135 may be a heater or other device known in the art for heating forced air. Temperatures attainable by heating element 135 may vary according to the desired operation of dryer 100, and may vary as set by controls 106.

Inlet air path 150 represents all the incoming air through vents 136. Inlet air path 150 also includes air from other parts of dryer 100, such as the front or sides, and is not limited to air flowing through vents 136. Inlet air path 150 also flows through heating element 135 into drum 104. As disclosed below, air may flow through drum 104 and exits dryer 100 through duct 130.

Dryer 100 also includes sensors or other information gathering devices to indicate temperatures, vapor pressure, parameter status, air flow and the like. This information may be forwarded to a processor 170. Processor 170 controls operations of dryer 100 and is coupled to controls 106 and other features. Processor 170 may execute steps or commands within a memory coupled to the processor.

Sensor 158 may be located in the vicinity of inlet air path 150 to determine the temperature of air flowing into drum 104. Based on the need of drum 104, processor 170 can adjust heating element 135 to a desired temperature so that the air in inlet air path 150 enters drum 104 at the desired temperature.

Sensors may also determine status for other areas, such as door 112 being opened. The sensors may comprise any known device used to determine temperature, vapor pressure or other parameters from an environment, especially air. In a basic configuration, sensors 156 and 158 are thermometers that simply relay a temperature reading. Alternatively, sensors 156 and 158 may determine air speed, humidity, force and the like of the air flowing over the respective sensor. Sensors 156 and 158 provide valuable feedback on operating dryer 100 and preventing injury to a user or product. A blast of hot air through door 112 could harm a user, as well as ruining article 102 due to overexposure to heated air.

For example, sensor 158 could indicate a start time to processor 170 for drum 104 to operate. After the time period, sensor 158 takes a reading at inlet air path 150 to make sure heating element 135 and dryer 100 are operating correctly. Sensor 156 is located in vent 134 and may serve the same purposes as sensor 158 by temperatures, air flow and the like.

Dryer 100 also includes a small door 160 to opening 162. Opening 162 accommodates dryer sheets, fabric softener, detergent, and the like placed into drum 104.

The outer structures of dryer 100 may be known as housing 190. Housing 190 may include door 112, sides of dryer 100, top panel 191, and rear panel 192. The sides may include panels extending from door 112 and the front of dryer 110 to rear panel 192. Bottom panel 193 also is part of housing 190. Drum 104 is enclosed within housing 190.

Figure 2:
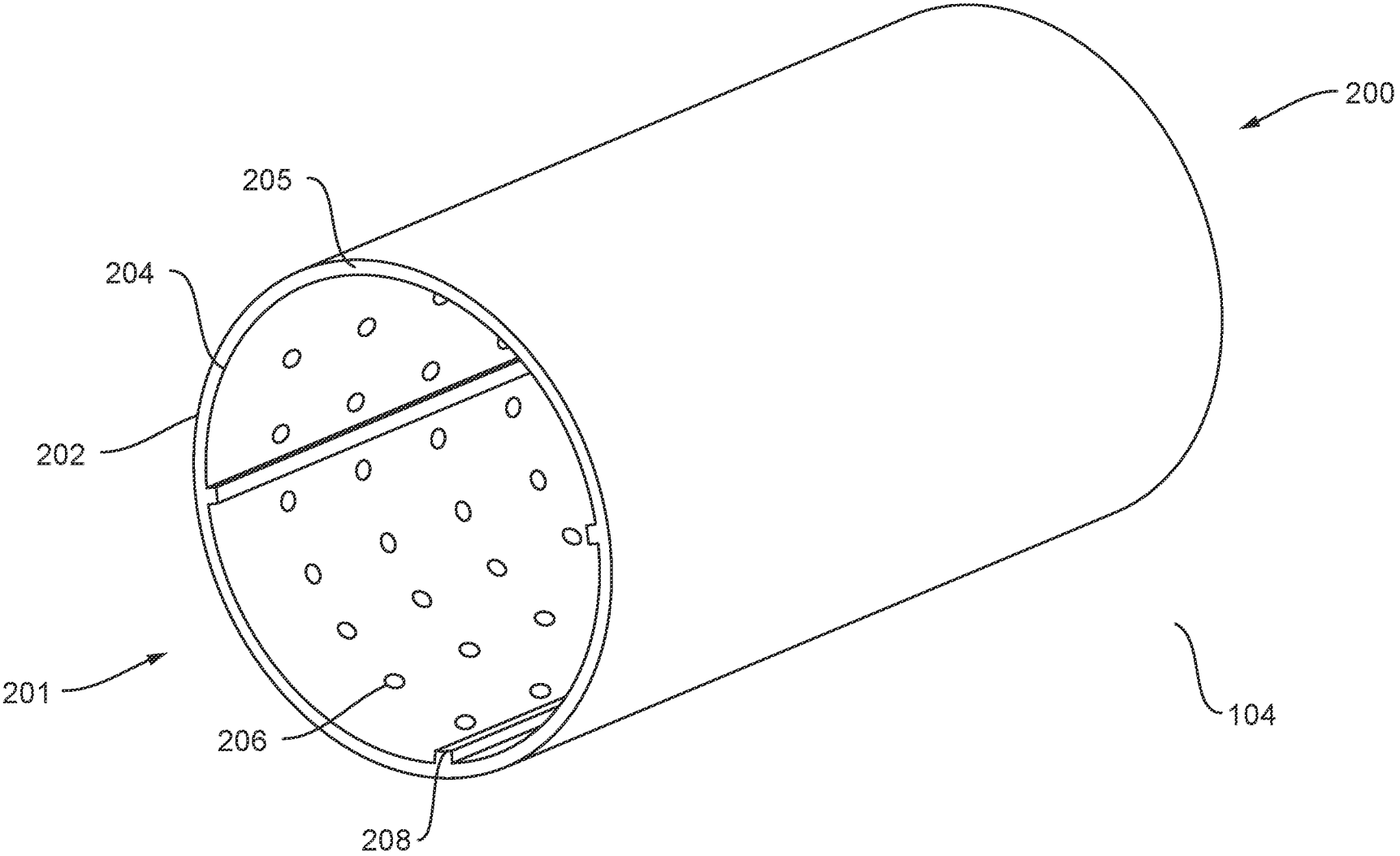
FIG. 2 illustrates a drum for a dryer according to the disclosed embodiments.

FIG. 2 depicts drum 104 according to the disclosed embodiments. Drum 104 is aligned with a rear side 200 and front side 201. Heated air from inlet air path 150 enters drum 104 from rear side 200 and exits through front side 201. As disclosed in greater detail below, an entry port and an exit port are defined to provide and remove the air from drum 104.

Drum 104 includes two walls having an air passage 205 therebetween. Outer cylindrical wall 202 is a solid metal structure that fits within dryer 100. Outer cylindrical wall 202 may be engaged to rotate drum 104 within dryer 100. Outer cylindrical wall 202 does not have any holes or outlet ports.

Inner cylindrical wall 204 is another metal structure that fits within outer cylindrical wall 202. A smaller diameter for inner cylindrical wall 204 allows it to fit into the outer cylindrical wall and define air passage 205. Inner cylindrical wall 204 rotates with outer cylindrical wall 202 to move articles 102 within drum 104. Inner cylindrical wall 204 also includes holes 206. Towards front side 201 of drum 104, the distance between outer cylindrical wall 202 and inner cylindrical wall 204 may be tapered down to close off that side of the drum. Thus, the heated air will only flow out of air passage 205 into the interior of drum 104.

Holes 206 are apertures through inner cylindrical wall 204 that connects the interior of drum 104 to air passage 205. Holes 206 may be spaced apart at regular intervals within inner cylindrical wall 204. Alternatively, the distance between holes 206 may vary as air flows toward front side 201. The size of holes 206 also may be consistent or may vary according to design. Any variance of hole size would be to encourage the air to flow towards articles 102, such as clothing.

In operation, the heated air from inlet air path 150 flows into air passage 205 between outer cylindrical wall 202 and inner cylindrical wall 204. The heated air does not escape out through outer cylindrical wall 202. It also does not necessarily flow into a middle portion of drum 104 to potentially miss contact with any of articles 102. Instead, the heated air flows through air passage 205 to holes 206. The heated air exits air passage 205 through holes 206 in inner cylindrical wall 204 to interact with articles 102 directly. As noted above, holes 206 may vary in size to encourage the heated air to move towards the front of drum 104 and to have longer contact/interaction with articles 102 in the drum.

Drum 104 also includes inserts 208. Inserts 208 are used to fit paddles or dividers to divide the interior of drum 104 into multiple spaces. Preferably, the dividers, disclosed in greater detail below, partition the interior of drum 104 into two or more spaces. The disclosed embodiments may utilize any number of inserts and dividers to form any number of spaces. Three spaces may be disclosed for illustrative purposes below. Inserts 208 may be grooves that receive a bottom portion of the dividers and hold the dividers in place during operation of drum 104.

Figure 3C:
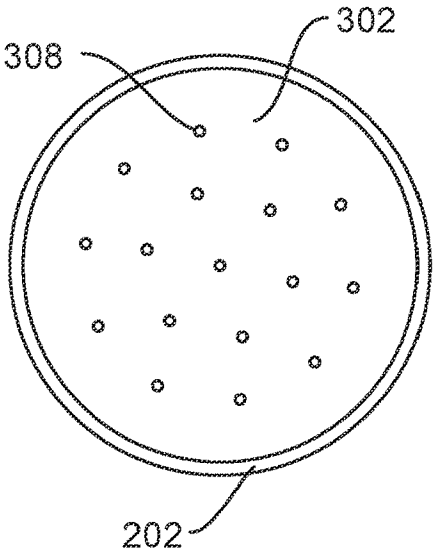
FIG. 3C illustrates the rear elevation view of the back plate for the inner drum according to the disclosed embodiments.
Figure 3B:
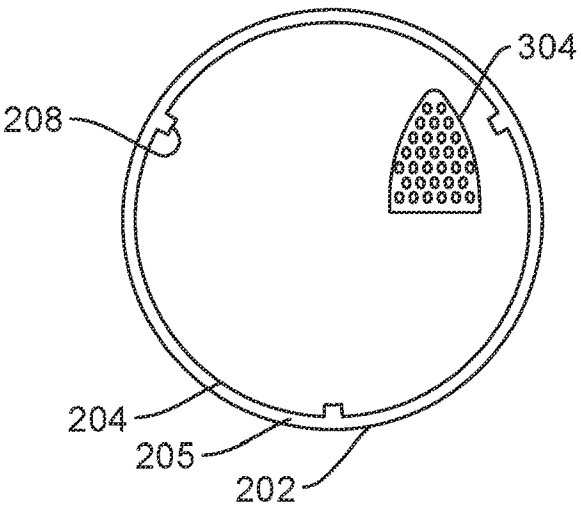
FIG. 3B illustrates a rear elevation view of the outer drum according to the disclosed embodiments.
Figure 3A:
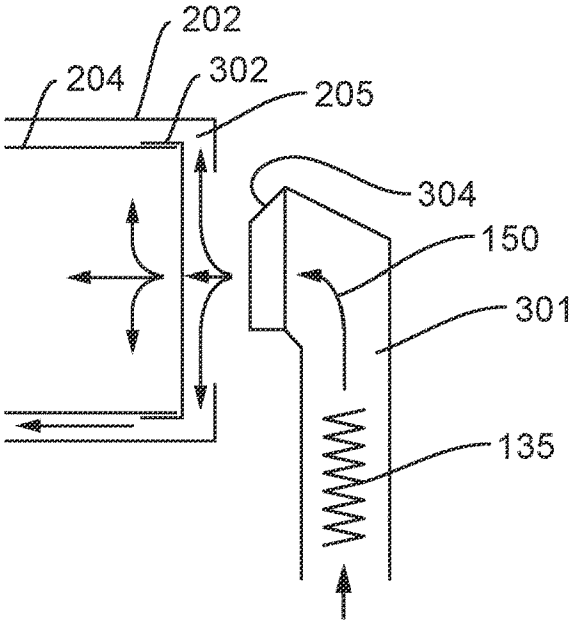
FIG. 3A illustrates a side view of a back plate of the drum according to the disclosed embodiments.

FIGS. 3A, 3B, and 3C depict back plate 302 of drum 104 according to the disclosed embodiments. FIG. 3A depicts a side view of air passage 301 to deliver heated air from inlet air path 150 into drum 104. Heating element 135 is shown. FIG. 3A differs slightly from the embodiment shown in FIG. 1, but one skilled in the art can appreciate any differences of air passage 301. Inlet air path 150 is heated by heating element 135 then dispersed into drum 104.

The heated air of inlet air path 150 flows into air passage 205 from air inlet 304. Air inlet 304 is shown in FIG. 3B. An open air inlet allows for more air to flow into drum 104 that is then used in the holes within the drum walls disclosed below. The disclosed embodiments may not sacrifice surface area provided for the heated air. In a conventional dryer, the heated air from air inlet 304 may flow directly into drum 104. According to the disclosed embodiments, the heated air flows into air passage 205 to be distributed throughout the air passage between outer cylindrical wall 202 and inner cylindrical wall 204 to exit through holes 206 into the interior of drum 104.

FIG. 3B shows drum 104 with back plate 302 removed. FIG. 3C shows drum 104 with back plate 302 and outer cylindrical wall 202 forming the rear of the inner drum. Back plate 302 includes holes 308, which act like holes 206 in inner cylindrical wall 204. Holes 308 allow heated air to pass through back plate 302 into the interior of drum 104. This feature allows most of the heated air to flow through air passage 205 to holes 206 in inner cylindrical plate 204. Alternatively, back plate 302 may not include any holes such that all of the heated air flows into air passage 205 between the walls.

Figure 4A:
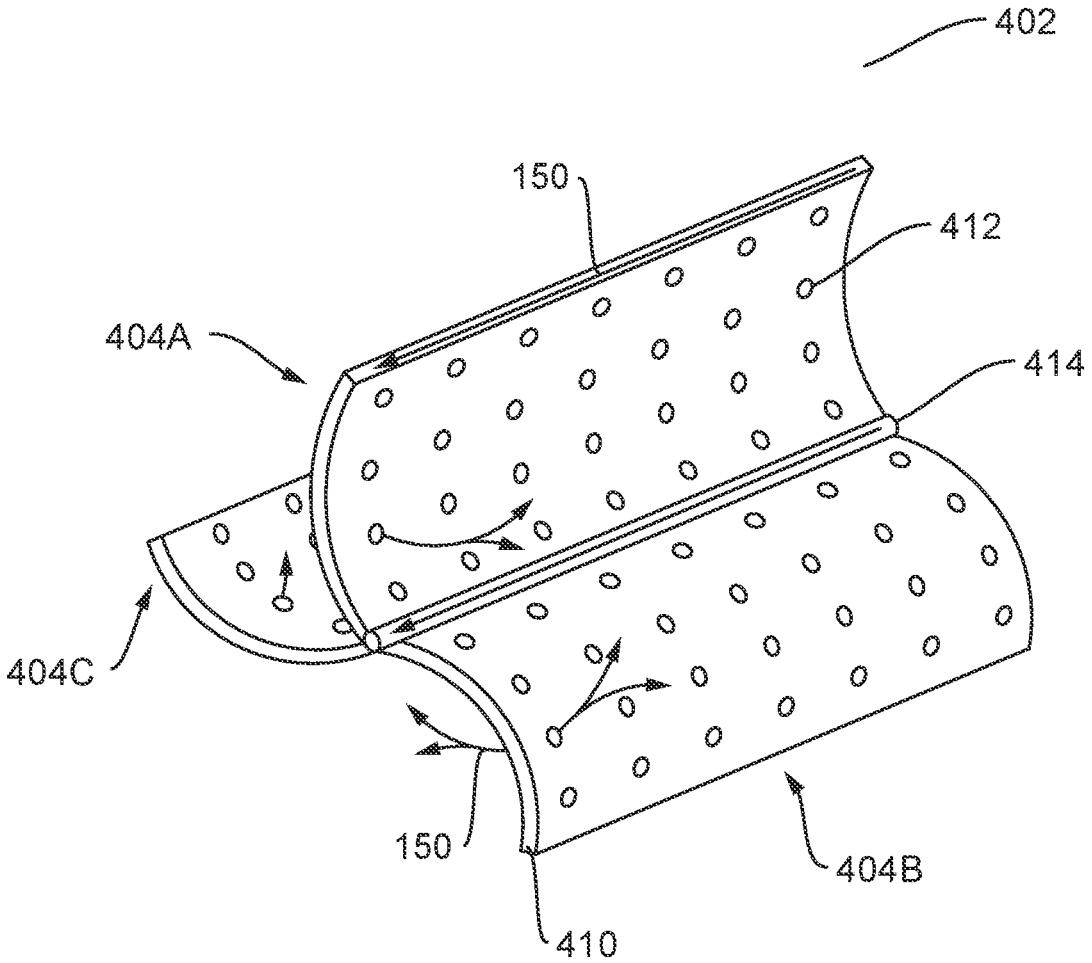
FIG. 4A illustrates an isometric view of an insert having dividers for use in the drum according to the disclosed embodiments.
Figure 4B:
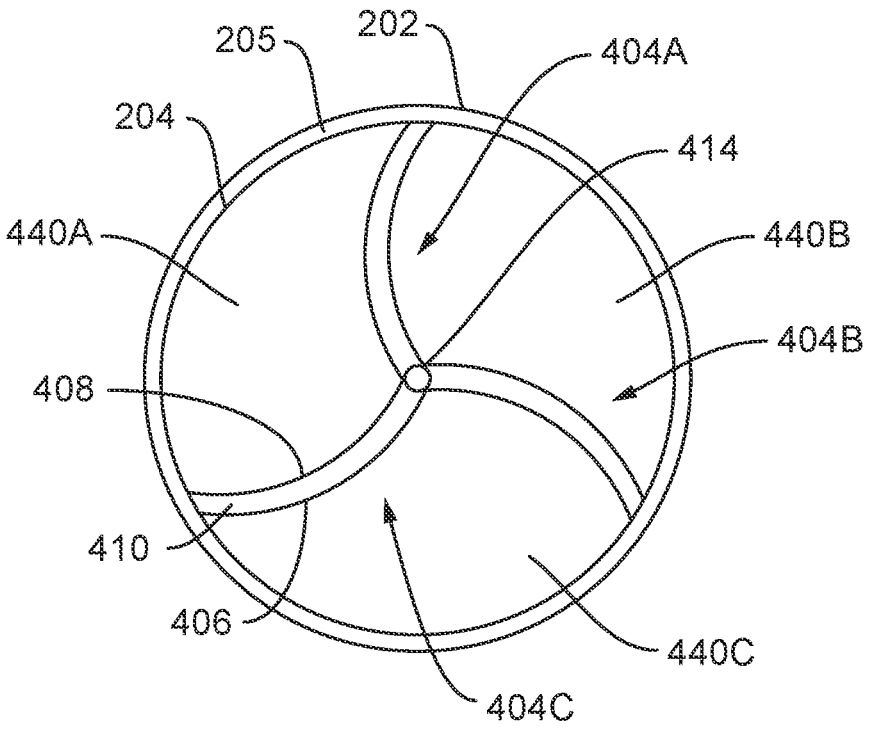
FIG. 4B illustrates a front elevation of the insert having dividers installed within the drum according to the disclosed embodiments.

FIGS. 4A and 4B depict an assembly 402 having dividers 404A-C for use in drum 104 according to the disclosed embodiments. Assembly 402 is shown with three dividers but it may include any number of dividers to form a variety of spaces. Assembly 402 may include an axial rod 414 to connect the dividers into one unit. Dividers 404A-C may collapse or move toward a reduced size around axial rod 414 to fit into drum 104 for installation. Once in drum 104, dividers 404A-C may be coupled to inserts 208, formed as ridges or grooves in inner cylindrical wall 204.

Assembly 402 also allows heated air to flow therethrough to exit holes 412 into the interior of drum 104. Dividers 404A-C may divide the interior of drum 104 into three interior spaces 440A-C. The number of spaces is not limited to three such that any number of spaces may be configured in drum 104. Articles 102 may be placed within each space 440A-C. As drum 104 rotates, the respective articles in each interior space stays within to come into contact with the heated air flowing out of holes 412 of assembly 402. Thus, the situation of the middle of drum 104 not having heated air making contact with articles 102 is avoided.

Each divider 404A-C includes an outer curved wall 406 and an inner curved wall 408. The dividers are curved to promote tumbling of articles 102 within the respective interior space. Walls 406 and 408 both have holes 412 to supply heated air into the spaces. Divider air passage 410 is formed between outer curved wall 406 and inner curved wall 408. Divider air passage 410 connects to air passage 205 to receive the heated air from inlet air path 150.

Thus, heated air may flow from heating element 135 into air passage 205 between outer cylindrical wall 202 and inner cylindrical wall 204. The heated air may exit holes 206 into spaces 440A-C. Further, the heated air may flow into divider air passages 410 for each divider 404A-C. In some embodiments, the number of holes 206 in inner cylindrical wall 204 may be reduced to promote air flow into divider air passages 410. The heated air then exits holes 412 into spaces 440A-C.

Figure 5:
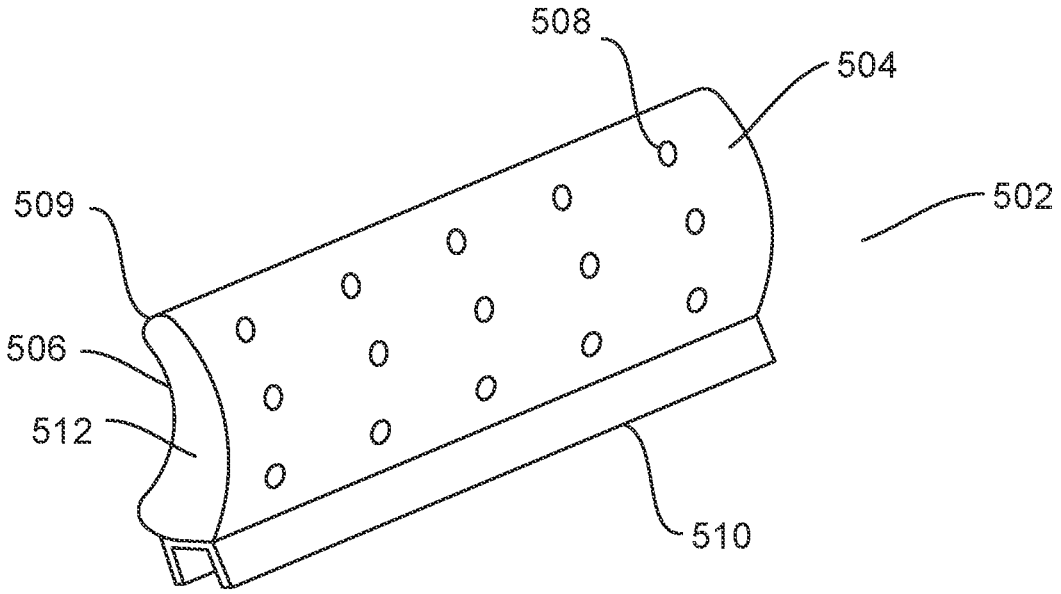
FIG. 5 illustrates an isometric view of a paddle for use within the drum according to the disclosed embodiments.

FIG. 5 depicts a paddle 502 for use within drum 104 according to the disclosed embodiments. Paddle 502 also may fit into inserts 208 within inner cylindrical wall 204 like dividers 404A-C of assembly 402. Paddle 502, however, does not create separate spaces within the interior of drum 104. Paddle 502, along with other paddles, may encourage the tumbling and movement of articles 102 within drum 104. Paddle 502 may be configured like a divider of assembly 402. Preferably, paddle 502 extends along the entire length of drum 104 from front side 201 to rear side 200.

Paddle 502 includes outer curved wall 504 and inner curved wall 506 so that the paddle uses the curved surfaces to promote tumbling of articles 102. Further, articles 102 should not get stuck or caught between paddle 502 and inner cylindrical wall 204. Walls 504 and 506 also include holes 508 to deliver heated air to the area adjacent paddle 502. Walls 504 and 506 also form paddle air passage 512 to provide the heated air to holes 508. Holes 508 within paddle 502 allows for more direct heated airflow to interact or contact an increased surface area of articles 102, such as wet clothes.

Paddle 502 also includes end portion 509, which also is curved to deflect articles 102 that may come into contact with the paddle. End portion 509, in some embodiments, may not have holes in it. Paddle 502 also includes connector 510 that attaches to an ridge or groove 208. Referring to assembly 402, dividers 404A-C may include connectors 510 to attach the assembly to drum 104. Connector 510 may slide or lock to ridge or groove 208. It also includes an open portion to allow the heated air to flow into paddle 502 from air passage 205.

Figure 6:
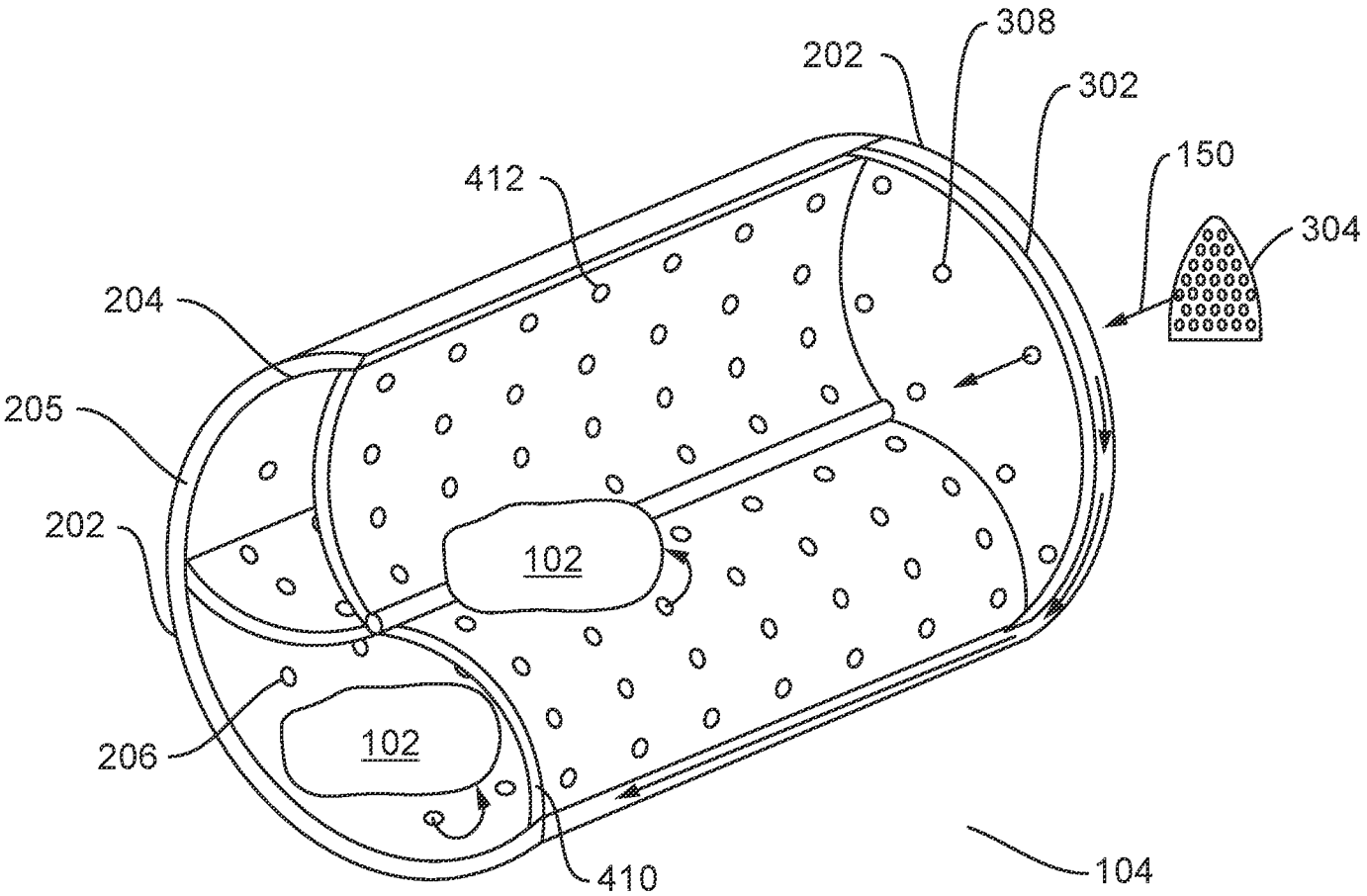
FIG. 6 illustrates an isometric view of the drum having the assembly installed therein according to the disclosed embodiments.

FIG. 6 depicts drum 104 having assembly 402 according to the disclosed embodiments. Portion of outer cylindrical wall 202 is cut away to show the interior space of drum 104 between the dividers of assembly 402. As shown, outer cylindrical wall 202 does not have any holes 206. In contrast, inner cylindrical walls 204 includes holes 206. Dividers 404A-C of assembly 402 also includes holes 412. Inlet air path 150 enters drum 104 through air inlet 304 and is pulled into air passage 205 to be distributed throughout drum 104 to come into direct contact with articles 102, which move within drum 104 during operation. Air flow moves around drum 104 to flow down the entire length of the drum and exit through either the dividers or paddles disclosed above thereby providing more direct heated air contact with articles 102.

As may be appreciated, lint and other debris may be generated during drying operations. As the articles are dried, particles may separate that could clog or block holes within drum 104. The disclosed embodiments, therefore, may include filters or screens over the holes to prevent these particles from accumulating within air passage 205. Air flows through the filters or screens as disclosed above but the particles are blocked from entering therein. In other embodiments, filters may be placed within the structures of drum 104 that allow air to flow. The surfaces within drum 104 may be wiped to remove any filtered particles, such as lint, from blocking the holes.

Figure 7:
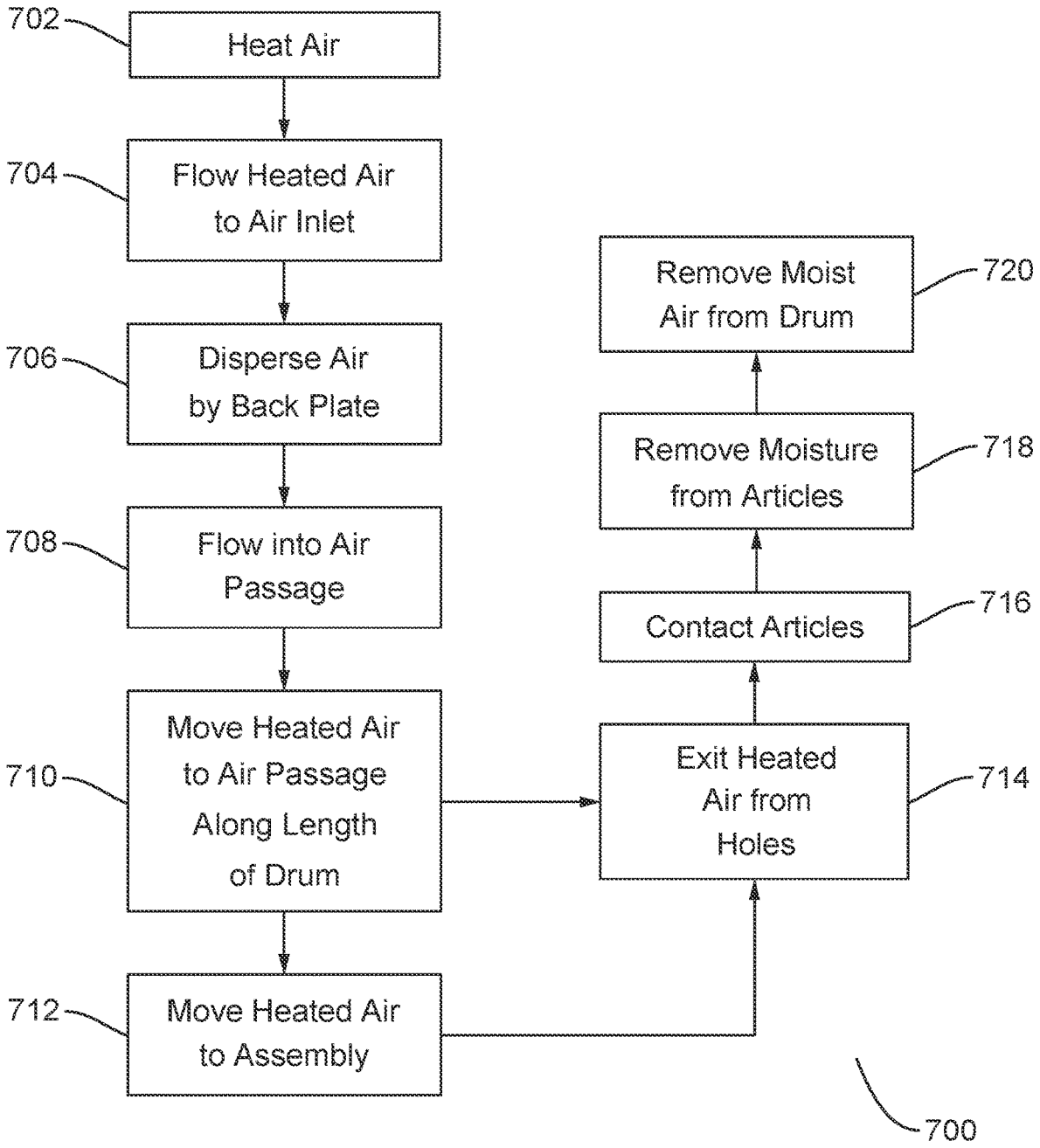
FIG. 7 illustrates a flowchart for drying articles using the drum according to the disclosed embodiments.

FIG. 7 depicts a flowchart 700 for drying articles using drum 104 according to the disclosed embodiments. Flowchart 700 may refer to components disclosed in FIGS. 1-6 for illustrative purposes. Flowchart 700, however, is not limited to the embodiments disclosed above. For example, dryer 100 or drum 104 may include additional features to enable to embodiments disclosed by flowchart 700.

Step 702 executes by heating air brought into dryer 100, as disclosed above. Inlet air path 150 may be formed by air coming into dryer 100. Inlet air path 150 passes through heating element 135 to increase the temperature of the air. Step 704 executes by flowing or moving the heated air to air inlet 304 within the housing of dryer 100. As shown in FIG. 3B, air inlet 304 provides the heated air into air passage 205 from back plate 302.

Step 706 executes by dispersing the heated air by back plate 302 into air passage 205. Back plate 302 also may allow some heated air to exit through holes 308 into the interior of drum 104. Step 708 executes by flowing the heated air into air passage 205 formed between outer cylindrical wall 202 and outer cylindrical wall 204. As disclosed above, air passage 205 may extend the length of drum 104. Thus, step 710 executes by moving the heated air into air passage 205 along the length of drum 104. This feature may be accomplished by tapering the size of air passage 205. Flowchart 700 may proceed to step 714, unless an assembly 402 is installed in drum 104. If so, then step 712 is executed.

Step 712 executes by moving the heated air into assembly 402. The heated air moves within dividers 404A-C within divider air passage 410. If paddle 502 is used, then the heated air moves into paddle air passage 512. The heated air enters dividers 404A-C or paddle 512 through inserts 208 and connectors 510.

Step 714 executes by exiting the heated air into the interior space or spaces of drum 104 through holes 206. If applicable, the heated air also exits holes 412 of dividers 404A-C or holes 508 of paddles 502. The heated air is delivered in a uniform manner within drum 104. The holes disclosed above provides more direct contact with the heated air to articles 102. The heated air is not limited in delivery to the rear of drum 104. These features improve the contact area of the articles with the heated air.

Step 716 executes by contacting articles 102 with the heated air from the holes in inner cylindrical wall 204 and, if applicable, dividers 404A-C or paddles 502. The heated air flows over articles 102 and interacts with the items to remove moisture, as disclosed in step 718. The heated air picks up the water molecules from articles 102 to dry them.

Step 720 executes by removing the moist air from drum 104. This step may be accomplished with a fan 154, as shown in FIG. 1.

In some embodiments, the surface area of the articles making contact with the heated air may be increased significantly, depending on the configuration within drum 104. For example, this increase may be 50 to 500%. It may be appreciated that more holes provide a greater likelihood that articles will come into contact with heated air as it enters the interior of drum 104.

It will be apparent to those skilled in the art that various modifications and variations can be made in the disclosed embodiments of the present invention without departing from the spirit or scope of the invention. Thus, it is intended that the present invention covers the modifications and variations of the embodiments disclosed above provided that they come within the scope of any claims and their equivalents.

What is claimed is:

1. A dryer comprising:
a housing;
an inlet air path into the housing;
an outlet air path out of the housing;
a heating element positioned to receive the inlet air path to heat air; and
a drum to receive the heated air and to rotate articles within the housing, wherein the drum is comprised of a metal structure, the drum consisting of
a metal outer cylindrical wall, wherein the outer cylindrical wall does not include holes,
a metal inner cylindrical wall to fit within the outer cylindrical wall, wherein holes are located within a cylindrical portion of the inner cylindrical wall,
a back plate connected to the inner cylindrical wall, wherein holes are located within the back plate, and
an air passage formed between the outer cylindrical wall and the inner cylindrical wall to receive the heated air from the inlet air path such that the outer cylindrical wall and the inner cylindrical wall are attached towards a front side of the drum to close the air passage,
wherein the heated air exits the air passage through the holes located in the inner cylindrical portion of the inner cylindrical wall and then exits the drum into the outlet air path.

2. The dryer of claim 1, wherein the drum further consists of an assembly to partition an interior of the drum defined by the inner cylindrical wall.

3. The dryer of claim 2, wherein the assembly includes at least one divider to extend the air passage having the heated air.

4. The dryer of claim 3, wherein the at least one divider to output the heated air into the divided interior of the drum.

5. The dryer of claim 2, wherein the assembly includes dividers to partition the interior of the drum into three spaces.

6. The dryer of claim 5, wherein the three spaces receive the heated air through the holes in the inner cylindrical wall of the drum and holes in the at least one divider.

7. The dryer of claim 1, wherein the drum further consists of at least one paddle connected to the inner cylindrical wall.

8. The dryer of claim 1, wherein a distance between the outer cylindrical wall and the inner cylindrical wall are tapered to close an end of the drum configured towards the front side.

9. The dryer of claim 1, wherein the heated air exits through the front side of the drum.

10. A drum to dry articles, the drum consisting of:
a metal structure including
a metal outer cylindrical wall, wherein the outer cylindrical wall does not include holes,
a metal inner cylindrical wall to fit within the outer cylindrical wall, wherein holes are located within a cylindrical portion of the inner cylindrical wall,
a back plate connected to the inner cylindrical wall, wherein holes are located within the back plate, and
an air passage formed between the outer cylindrical wall and the inner cylindrical wall to receive air to flow into an interior of the drum, wherein the interior is defined by the inner cylindrical wall, such that the outer cylindrical wall and the inner cylindrical wall are attached towards a front side of the drum to close the air passage,
wherein the air exits the air passage through the holes located in the cylindrical portion of the inner cylindrical wall.

11. The drum of claim 10, wherein the drum further consists of an assembly to partition the interior of the drum defined by the inner cylindrical wall.

12. The drum of claim 11, wherein the assembly includes at least one divider to extend the air passage having the air.

13. The drum of claim 12, wherein the at least one divider includes holes to output the air into the divided interior of the drum.

14. The drum of claim 11, wherein the assembly includes three dividers to partition the interior of the drum into three spaces.

15. The drum of claim 14, wherein the three spaces receive the air through the holes in the inner cylindrical wall of the drum and holes in the at least one divider.

16. The drum of claim 10, further consisting of at least one paddle connected to the inner cylindrical wall.

17. The drum to dry articles of claim 10, wherein a distance between the outer cylindrical wall and the inner cylindrical wall are tapered to close an end of the drum configured towards the front side.

18. A method for drying articles within a dryer, the method comprising:
heating air within an inlet air path within the dryer;
flowing the heated air through an air inlet to a drum;
moving the heated air within an air passage formed by a metal outer cylindrical wall and a metal inner cylindrical wall of the drum such that the outer cylindrical wall and the inner cylindrical wall are attached towards a front side of the drum to close the air passage to prevent the heated air from flowing from a front end of the air passage,
wherein a back plate is connected to the inner cylindrical wall,
wherein holes are located within a cylindrical portion of the inner cylindrical wall and holes are located within the back plate and wherein holes are not located within the outer cylindrical wall;
exiting the heated air from the air passage through the holes in the cylindrical portion of the inner cylindrical wall into an interior of the drum, wherein no air exits through the outer cylindrical wall; and
removing moisture from the articles within the interior of the drum using the heated air.

19. The method of claim 18, further comprising flowing the heated air into an assembly fitted within the drum.

20. The method of claim 19, further comprising exiting the heated air from holes within the assembly.

* * * * *